United States Patent [19]

Arena

[11] 3,998,361

[45] Dec. 21, 1976

[54] MANUALLY PRESSURIZABLE SPRAY DISPENSER

[75] Inventor: John P. Arena, New Rochelle, N.Y.

[73] Assignee: Raymond Lee Organization, Inc., a part interest

[22] Filed: Feb. 9, 1976

[21] Appl. No.: 656,432

[52] U.S. Cl. ..... 222/182; 222/402

[51] Int. Cl.[2] ..... B65D 83/14

[58] Field of Search ..... 222/402.13, 182, 384, 222/373, 401, 402, 400.8

[56] References Cited

UNITED STATES PATENTS

| | | | |
|---|---|---|---|
| 2,256,113 | 9/1941 | Gray | 222/402 X |
| 2,631,762 | 3/1953 | Perwas | 222/402 |
| 3,282,510 | 11/1966 | Schwartz | 239/373 |
| 3,876,113 | 4/1975 | Trotta | 222/182 |

*Primary Examiner*—Stanley H. Tollberg

[57] ABSTRACT

A hollow, cylindrical, vertically elongated body has an open top and a closed bottom. A cap is detachably securable to the top of the body to seal the interior to a spray dispenser with a spray head is located in the cap. A manually operable pump is attached to the body so as to allow the contents of the body to be pressurized. A protective hood is attached to the cap, and surrounds the dispenser head, so as to prevent the dispenser from being accidentally operated.

1 Claim, 3 Drawing Figures

MANUALLY PRESSURIZABLE SPRAY DISPENSER

SUMMARY OF THE INVENTION

This invention is designed to provide a dispenser for liquids that can be manually pressurized with but one finger of the user's hand. Additionally, the invention also provides a hood that will prevent the contents placed in the invention from being dispersed or sprayed out accidentally.

DETAILED DESCRIPTION OF PREFERRED EMBODIMENT

Figure 1:
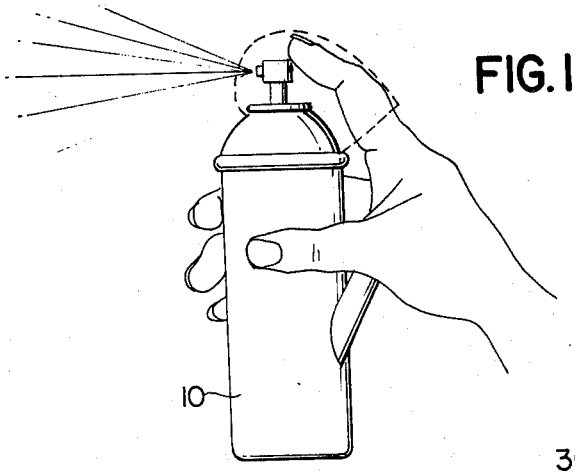
FIG. 1 shows the invention in use.
Figure 2:
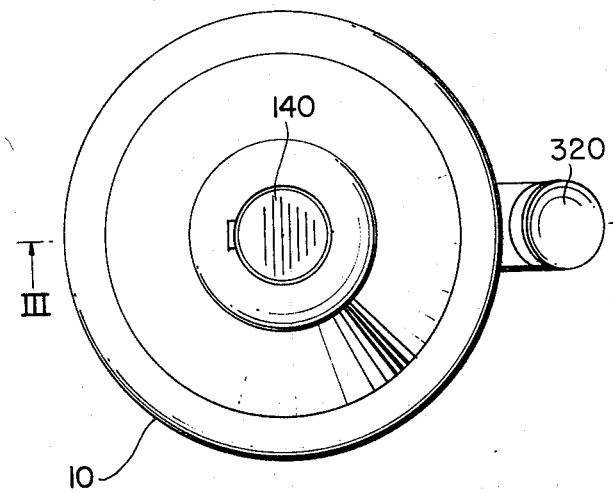
FIG. 2 shows a top view of the invention.
Figure 3:
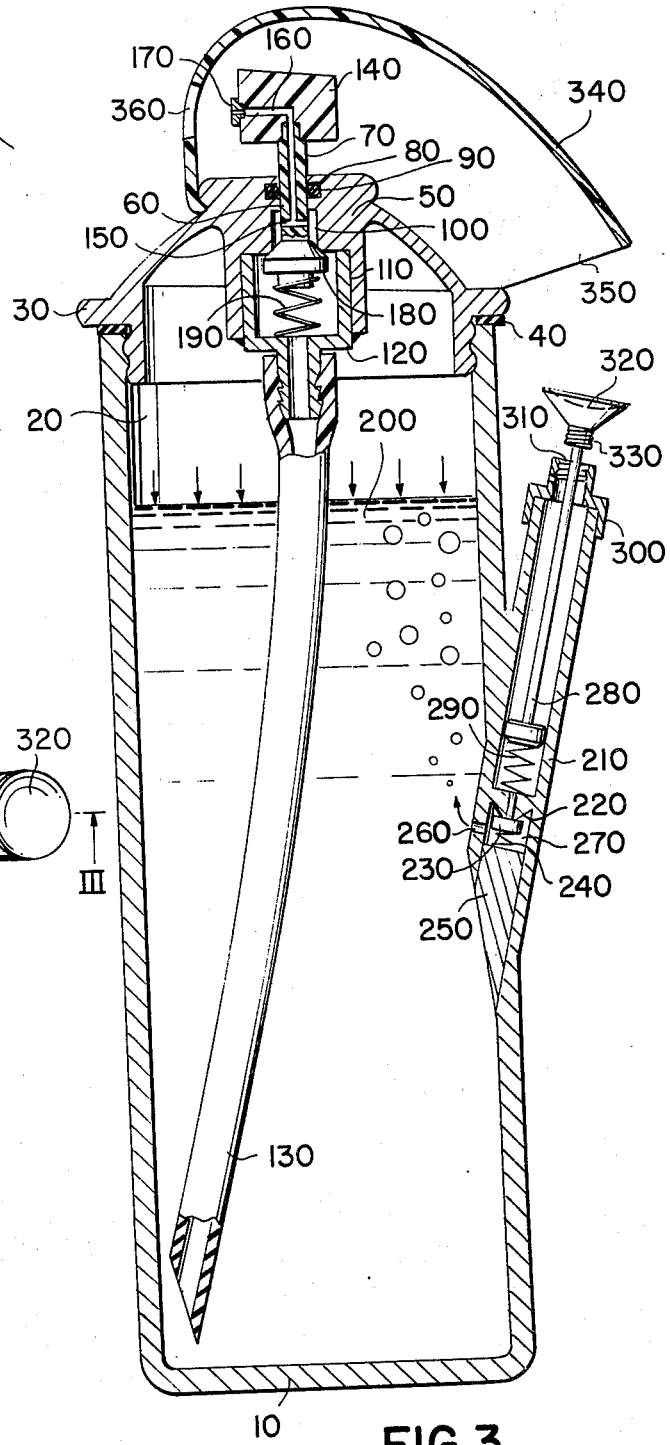
FIG. 3 is a view taken along line 3—3 in FIG. 2.

Referring now to FIGS. 1–3, cylindrical body 10 has a hollow interior 20, an open top and a closed bottom. A cap 30 is threadedly securable to the top of the body to seal the interior off. It is to be noted that the cap threads into the interior wall of thy body and that a seal is effected by means of an annular gasket 40 located between the bottom of the cap and the top of the body.

The cap, as is shown in FIG. 3, generally takes the form of a hollow dome. In the apex of the cap, a generally cylindrical plug 50 is molded. This plug has a number of walls and recesses cut into its interior, to allow a spray dispenser mechanism to be installed in the cap. All these walls and recesses are radially symmetrical about the vertical centerline of the plug.

Wall 60 extends vertically downwardly through the top of the plug, to accommodate shaft 70, described in more detail below. Slightly below the top of the plug, well 60 opens up into circular recess 80, which contains a flexible doughnut-type seal 90 to form a seal between the shaft and the plug. After going downwardly from recess 90, the well 60 opens up into a cylindrical recess 100. Recess 100 communicates at its open bottom with cylindrical well 110, which extends upwardly into the plug from the bottom.

Piece 120 has a hollow cylindrical top end with an open top. This top end just fits into well 110, and is glued therein. Extending downwardly in line with the centerline of the plug is a generally cylindrical extension of piece 120. The extension has a central base that communicates with the interior of well 110. The outside of the extension is corrugated, so as to force hollow tube 130 to remain on the extension after being slipped over it.

A generally rectangular pushbutton 140 is attached to the top of the shaft. It can be seen that the shaft has a T-shaped passageway 150 inside its body, with the crosspiece of the T being horizontally located and the tail of the T extending vertically upwardly from the crosspiece along the centerline. This passageway then communicates with L-shaped passageway 160 in the pushbutton. At the front of the pushbutton, passageway 160 terminates in spray head 170.

At the bottom of the shaft is a circular valve seal 180. This seal is normally pressed against the circular ridge between recess 100 and well 110 by compression spring 190. However, it can be seen that if liquid 200 inside interior 20 is under pressure and the pushbutton is depressed, the liquid will flow up tube 130, into piece 120, into well 110, past the valve seal, into passageways 150 and 160, and out spray head 170. Thus depressing the pushbutton will allow the pressurized liquid to be sprayed from out of the device and removing the downward pressure on the pushbutton will cause the spray to press the seal up again, stopping the spray.

A pump is used to pressurize the liquid, the pump has a hollow cylindrical housing 210 extending upwardly and outwardly from a point in the middle of the body. The body and the housing are molded together as one piece.

A toroidal construction 220 is planed near the bottom of the interior of the housing. Pressed upwardly against the bottom of the construction is check 230. Check 230 is pressed upwardly by compression spring 240, which is located between the check and a plug 250 that is driven upwardly into the interior of the housing to seal the housing off at its lower end. In the wall of the housing is part 260, that connects the interior 20 and the space 270 between plug 250 and construction 210.

It can be seen that the check 230, spring 240 and constriction 220 form a one-way check valve that will allow to be forced only into the interior 20 and not out of it.

A plunger 280 fits loosely in housing 210. Compression spring 290 presses the plunger upwardly. Thus, moving the plunger up and down in the housing will allow air to be forced into the interior 20, pressurizing the liquid.

At the top of the housing is a top piece 300. The top piece has a tapped hole 310 through which the plunger passes. A knob 320 is attached to the top of the plunger and has a downwardly extending threaded portion 330. When the pump is not being used, the knob can be threaded into the top piece to protect the plunger from breakage.

Finally, a hood 340 surrounds the pushbutton. The hood is a shell that is attached to the cap in front of the button and extends upwardly and rearwardly above the button to cover it, and then extends downwardly and rearwardly to an opening 350 that allows a user's finger to be inserted as shown in FIG. 1. A hole is located in front of the spray head to allow material to be sprayed forwardly out of the hood.

I claim:

1. A manually pressurizable spray dispenser, comprising:

a hollow, vertically elongated cylindrical body with a closed bottom and an open top;

a hollow cylindrical housing with a cylindrical interior base and an open top end attached to the body intermediate the ends of the body and extending upwardly and outwardly from it;

a one way check valve communicating with the interiors of the body and the housing in a manner that air may flow from the interior of the housing to the interior of the body and not in the opposite direction;

a plunger located in the housing and being freely slidable upwardly and downwardly therein;

a top attached to the top end of the housing and having a tapped hole through which the plunger passes;

a knob attached to the top of the plunger, the knob having a threaded portion that can engage the tapped hole when the pump is not in use and thereby keep the plunger wholly inside the housing;

a cap threadably secured to the top of the body to seal the interior of the body off from the outside;

a spray dispenser with a spray head attached to the cap; and a protective hood attached to the cap and surrounding the dispenser head to prevent the dispenser from being inadvertantly opened.

* * * * *